US007025111B2

(12) United States Patent
Barth et al.

(10) Patent No.: US 7,025,111 B2
(45) Date of Patent: Apr. 11, 2006

(54) METHOD FOR COATING A METALLIC COMPONENT

(75) Inventors: Andreas Barth, Leinfelden (DE); Marita Bauer, Esslingen (DE); Wilfrid Polley, Welzheim (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/296,622

(22) PCT Filed: May 22, 2001

(86) PCT No.: PCT/EP01/05871

§ 371 (c)(1),
(2), (4) Date: Jul. 21, 2003

(87) PCT Pub. No.: WO01/92600

PCT Pub. Date: Dec. 6, 2001

(65) Prior Publication Data

US 2004/0040686 A1 Mar. 4, 2004

(30) Foreign Application Priority Data

May 26, 2000 (DE) ..... 100 26 338

(51) Int. Cl.
*B22D 17/20* (2006.01)

(52) U.S. Cl. ..... 164/72; 164/267

(58) Field of Classification Search ..... 164/72, 164/267, 312

See application file for complete search history.

(56) References Cited

U.S. PATENT DOCUMENTS

| | | | | |
|---|---|---|---|---|
| 3,877,141 | A * | 4/1975 | Bradshaw et al. | 29/527.5 |
| 3,963,502 | A * | 6/1976 | Borbely et al. | 106/38.28 |
| 4,977,947 | A * | 12/1990 | Boswell et al. | 164/71.1 |
| 4,978,432 | A | 12/1990 | Schmeling et al. | 205/108 |
| 5,076,339 | A * | 12/1991 | Smith | 164/72 |
| 5,279,750 | A * | 1/1994 | Hanano | 508/155 |
| 5,662,156 | A * | 9/1997 | Freeman | 164/61 |
| 5,842,510 | A * | 12/1998 | Nagashima et al. | 164/72 |
| 6,073,676 | A * | 6/2000 | Hairy et al. | 164/4.1 |
| 6,192,968 | B1 * | 2/2001 | Renkl et al. | 164/121 |

FOREIGN PATENT DOCUMENTS

| | | |
|---|---|---|
| DE | 35 077 | 11/1965 |
| DE | 2 006 095 | 8/1971 |
| DE | 33 30 494 | 7/1984 |
| DE | 34 36 846 | 7/1985 |
| DE | 3436846 | 7/1985 |
| EP | 333 048 | 3/1989 |
| EP | 0 810 046 | 5/1997 |
| JP | 62 173065 | 7/1987 |
| JP | 08 090147 | 4/1996 |

OTHER PUBLICATIONS

International Search Report

* cited by examiner

*Primary Examiner*—Len Tran
(74) *Attorney, Agent, or Firm*—Crowell & Moring LLP

(57) ABSTRACT

A process for coating a metallic component with a corrosion-resistant layer comprises providing a metallic shaping tool that is at least partially sprayed with concentrated mold release agent. The component is cast in the metallic shaping tool, the concentrated mold release agent being fired into a surface of the component during the solidification of the component.

6 Claims, 1 Drawing Sheet

METHOD FOR COATING A METALLIC COMPONENT

FIELD OF THE INVENTION

Figure 1:
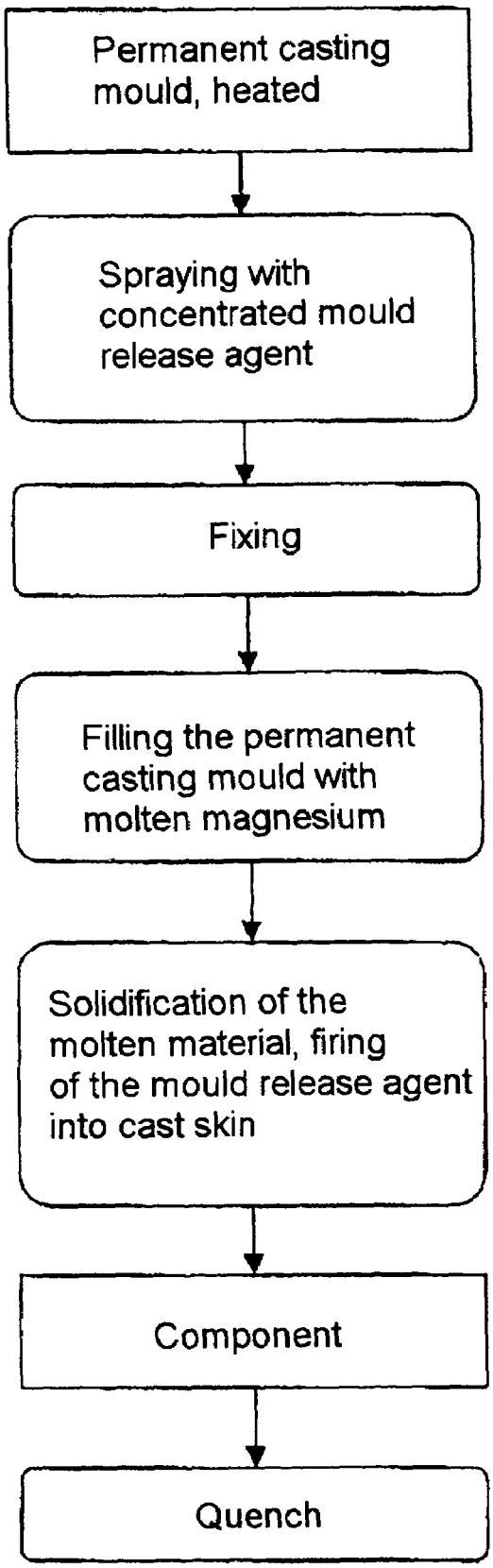

The invention relates to a process for coating a metallic component with a corrosion-resistant layer.

BACKGROUND AND SUMMARY OF THE INVENTION

To implement lightweight structural concepts with a view to saving fuel, light metal components, for example, components made from aluminum or magnesium, are being used to an increasing extent in particular in the automotive industry. The components are generally cast, forged or extruded.

The said metals and their alloys form a passivation layer at the surface, and under standard climate conditions this layer provides good protection against corrosion. On the other hand, when exposed to media which promote corrosion, such as water and salt, these metals are subject to unacceptable levels of corrosive attack.

Numerous measures for coating light metals, in particular magnesium, have been developed to combat this problem. One standard process for producing a protection against corrosion on light metals consists of electrolytic coating, as described, for example, in EP 0 333 048. On the other hand, the drawback of this process resides in the complex and expensive retrospective coating of the components.

Accordingly, the object of the invention is to provide a process for preventing corrosion of light metal components which is less expensive than that used in the prior art.

The solution to the object comprises the features described below.

BRIEF DESCRIPTION OF THE DRAWING FIGURE

FIG. 1 shows a schematic casting process according to the present invention.

DETAILED DESCRIPTION OF THE INVENTION

Light metal components are generally produced in metallic shaping tools using elevated temperatures. In these processes, the shaping tools are sprayed with a mold release agent before the shaping process takes place. The mold release agent adheres to the surface of the shaping tool and assists with demolding of a shaped component, since the adhesion between the shaping tool and the component is reduced. The mold release agent which is customarily used in the shaping process consists of 98% to 99% water which contains between 1% and 2% of an organic substance based on waxes.

According to the invention, it has been found that when concentrated mold release agents are used, the organic substance in the mold release agent is fired into a surface of the component, where it has a significant corrosion-inhibiting effect. In the present context, the term firing in is understood as meaning the formation of a continuous surface layer during the solidification of the component. This layer is securely joined to the surface of the component and cannot be washed off. It has been found that, depending on the nature of the organic substance, a mold release agent which contains more than 15% of organic substance (referred to below as a concentrated mold release agent) already has a corrosion-inhibiting action. The corrosion-inhibiting properties become greater as the concentration of organic substance in the mold release agent increases. The best protection against corrosion is achieved by the undiluted organic substance.

To reduce process costs, it is possible for the shaping tool to be only partially sprayed with concentrated mold release agent, while the other areas are treated with conventional, dilute mold release agent. Of course, this only leads to partial protection against corrosion and can be used if only certain areas of the component are exposed to corrosive media.

Accordingly, the process according to the invention involves in-situ coating of the component. Although a slightly greater quantity of organic substance is required in the mold release agent to produce the component, the costs of the organic substance are relatively low. In this process, there is no need to introduce a further coating process and no further additives are supplied to the process.

The process according to the invention can be used in all shaping processes for light metals in which permanent metallic shaping tools (which may, if appropriate, include ceramic or hard-metal layers or inserts) are used. During the shaping process, the shaping tools must be at a temperature of at least 80° C., preferably 150° C. to 400° C., in order to ensure that the agent is fired in on the component surface. Examples of suitable shaping tools are permanent casting molds, press tools, forging tools, rolling tools, drawing tools or extrusion dies. The process according to the invention is particularly suitable for components which are produced by casting in permanent casting molds or by forging in forging tools.

The best results with regard to protection against corrosion are achieved if the organic substance is based on waxes. These include paraffins and saturated fatty acids derived from glycerol esters. These substances are fired into the cast skin of the component particularly successfully without any decomposition taking place.

Decomposition of the organic substances would have an adverse effect on the protection against corrosion. To avoid decomposition of the organic substance on the component surface, it is expedient, within the context of the process according to the invention, for the component to be quenched in water immediately after the shaping.

During the shaping process, the temperature of the shaping tool is generally held at a temperature between 150° C. and 400° C. If the concentrated mold release agent is sprayed onto the hot surface of the shaping tool, the organic substances are at least partially dried. This leads to the organic substance being fixed in place and to a uniform surface layer on the component surface. In this context, it is expedient to take account of a fixing time of up to 30 seconds.

Light metal components made from aluminum, magnesium, zinc or alloys of these metals are particularly suitable for coating by the process according to the invention.

The drawing figure diagrammatically depicts the sequence of the process according to the invention on the basis of a casting process which is described in more detail in Example 1. Example 2 describes the use of the process according to the invention for coating a forged component.

EXAMPLE 1

To produce a housing part for a passenger car auxiliary unit made from the magnesium alloy AS21, a suitable permanent casting mold is sprayed with a concentrated mold release agent, which consists of 30% of water and 70% of an organic substance based on glycerol ester, so that the surface is covered.

After a waiting time of approximately 15 seconds, the water in the mold release agent is largely evaporated and the organic substance is fixed to the permanent casting mold, the temperature of which is held at approximately 250° C. Then, the permanent casting mold is filled under pressure with the molten magnesium alloy (molten magnesium), which is at a temperature of 650° C. The mold release agent which is fixed to the surface of the permanent casting mold prevents the surface of the mold from being wetted with the molten magnesium during the filling operation. In this process phase, there is scarcely any interaction between the molten material and the mold release agent.

After complete filling, the molten magnesium solidifies to form a component. The solidification operation lasts about 15 seconds. During this time, a cast skin is formed on the surface of the permanent casting mold and forms the surface of the component after demolding. During the solidification, some of the fixed release agent is dissolved and fired into the cast skin. This does not involve any long-term damage to the chemical structure of the mold release agent. To prevent decomposition of the fired-in mold release agent during a prolonged cooling phase, the component is quenched in water.

The coating of the component surface with the mold release agent is continuously joined and secured to the surface after the quenching, thus ensuring permanent protection against corrosion. The component which has been coated using the process according to the invention, as well as an uncoated but otherwise identical component, was subjected to the VDA (Verband Deutscher Automobilindustrie—German Automotive Industry Association) changing-conditions test. The VDA changing-conditions test is composed of a defined series of corrosion tests in accordance with DIN standards. In the test, the components are sprayed with salt for 24 hours (in accordance with DIN 50021 SS) and are then exposed to a changing climate test between 120° C. and −40° C. for 96 hours at 90% relative atmospheric humidity (in accordance with DIN 50017 KFW) and, finally, held under a defined climate at room temperature for 48 hours.

Visual inspection of the components revealed the following results:

The uncoated component has a surface which is highly encrusted with oxides. Fine surface structures are no longer apparent. By contrast, the component which has been coated in accordance with the invention remained virtually unchanged; there are only slight surface defects at sharp edges, where the mold release agent could not be fired into the surface to such a strong extent as elsewhere.

EXAMPLE 2

A mold release agent which consists of 85% water and 15% waxes based on paraffins is sprayed onto a forging tool which has a surface temperature of 200° C. Initially, the mold release agent dries on the forging tool, leading to local fixing of the mold release agent. A waiting time of approximately 30 seconds is set for optimum fixing.

An aluminum semifinished product consisting of the alloy AlMgSil is preheated to approximately 370° C. and shaped into an aluminum component in the form of a tension strut in the forging tool. During the shaping process, some of the wax component of the mold release agent is fired into the surface of the aluminum component. Sufficient wax remains on the surface of the shaping tool to ensure demolding of the component.

This is followed by solution annealing of the component at 550° C. in air for 6 hours. This heat treatment resulted in further, deeper firing of the wax into the surface, with the result that it was possible to improve the effect of the coating still further. No decomposition of the wax was observed during this heat treatment.

The coating of the aluminum surface with wax which has been fired in according to the invention means that the surface is protected against corrosion. The component is subjected to a corrosion test similar to that carried out in Example 1. A comparison with an uncoated component of the same design reveals the same result as in Example 1.

The invention claimed is:

1. A process for coating a metallic component with a corrosion-resistant layer, comprising:

at least partially spraying a metallic shaping mold with a concentrated mold release agent containing at least 15% organic material based on waxes;

shaping the component in the metallic shaping mold which has a temperature between 150° and 400° C. during the shaping;

baking the concentrated mold release agent onto a surface of the component during solidification of the component; and forming the corrosion-resistant layer on the metallic component.

2. A process according to claim 1, wherein said shaping tool is selected from the group consisting of a permanent casting mold, a forging tool, a press tool, a rolling tool, a drawing tool, and an extrusion die.

3. A process according to claim 1, further comprising quenching the metal component immediately after said shaping.

4. A process according to claim 1, wherein said shaping tool is heated before and during said shaping, and the mold release agent on the shaping tool is at least partially dried prior to said shaping.

5. A process according to claim 1, wherein the component consists of a material selected from the group consisting of aluminum, magnesium, and zinc and alloys of aluminum, magnesium, and zinc.

6. A coated metallic component formed by the process of claim 1.

* * * * *